US009093203B2

(12) United States Patent
Depping et al.

(10) Patent No.: US 9,093,203 B2
(45) Date of Patent: Jul. 28, 2015

(54) OVERVOLTAGE PROTECTION ELEMENT

(75) Inventors: Christian Depping, Lemgo (DE); Rainer Durth, Horn-Bad Meinberg (DE); Gernot Finis, Kassel (DE); Thomas Meyer, Ottenstein (DE); Andreas Christ, Marl (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 315 days.

(21) Appl. No.: 13/508,219

(22) PCT Filed: Nov. 5, 2010

(86) PCT No.: PCT/EP2010/006738

§ 371 (c)(1),
(2), (4) Date: May 30, 2012

(87) PCT Pub. No.: WO2011/054524

PCT Pub. Date: May 12, 2011

(65) Prior Publication Data

US 2012/0229246 A1 Sep. 13, 2012

(30) Foreign Application Priority Data

Nov. 5, 2009 (DE) ..... 10 2009 053 145
Oct. 20, 2010 (DE) ..... 20 2010 014 430 U
Oct. 20, 2010 (DE) ..... 20 2010 014 431 U

(51) Int. Cl.
*H01H 71/18* (2006.01)
*H01H 71/14* (2006.01)
(Continued)

(52) U.S. Cl.
CPC ..... *H01C 7/12* (2013.01); *H01C 7/126* (2013.01); *H01H 37/46* (2013.01); *H01T 1/14* (2013.01);
(Continued)

(58) Field of Classification Search
CPC ..... H01C 7/12; H01C 7/126; H01H 37/46; H01H 1/20; H01H 2037/769; H01H 37/74; H01H 37/767; H01T 1/14
USPC ..... 337/206, 5, 6, 405, 406, 142, 79, 114, 337/148, 186, 123, 139, 393, 382; 338/21, 338/22 SD
See application file for complete search history.

(56) References Cited

U.S. PATENT DOCUMENTS

RE28,545 E * 9/1975 Harris ..... 60/520
4,047,143 A * 9/1977 Burden et al. ..... 337/239
(Continued)

FOREIGN PATENT DOCUMENTS

DE 36 32 224 A1 4/1988
DE 36 43 622 A1 6/1988
(Continued)

*Primary Examiner* — Anatoly Vortman
(74) *Attorney, Agent, or Firm* — Roberts Mlotkowski Safran & Cole, P.C.; David S. Safran

(57) ABSTRACT

An overvoltage protection element with a housing, an overvoltage-limiting component arranged in the housing, and with two connection elements for electrically connecting the overvoltage protection element to the current or signal path to be protected, wherein, normally, the connection elements are each in electrically conductive contact with a pole of the overvoltage-limiting component. Reliable and effective electrical connection in the normal state and reliable isolation of a defective overvoltage-limiting component are ensured by the fact that a thermally expandable material is arranged within the housing in a way that, in the event of thermal overloading of the overvoltage-limiting component, the position of the overvoltage-limiting component is changed by expansion of the thermally expandable material relative to the position of the connection elements in a way that causes at least one pole of the overvoltage-limiting component to be out of electrically conductive contact with the corresponding connection element.

20 Claims, 8 Drawing Sheets

(51) Int. Cl.

| | |
|---|---|
| ***H01C 7/12*** | (2006.01) |
| ***H01H 37/46*** | (2006.01) |
| ***H01T 1/14*** | (2006.01) |
| *H01H 1/20* | (2006.01) |
| *H01H 37/76* | (2006.01) |
| *H01H 37/74* | (2006.01) |

(52) U.S. Cl.
CPC ..... *H01H 1/20* (2013.01); *H01H 37/74* (2013.01); *H01H 37/767* (2013.01); *H01H 2037/769* (2013.01)

(56) References Cited

U.S. PATENT DOCUMENTS

| | | | | |
|---|---|---|---|---|
| 4,186,366 | A * | 1/1980 | McVey | 337/407 |
| 4,288,833 | A * | 9/1981 | Howell | 361/124 |
| 4,538,347 | A * | 9/1985 | Palilla et al. | 29/619 |
| 5,014,036 | A * | 5/1991 | Komoto | 337/407 |
| 5,708,553 | A * | 1/1998 | Hung | 361/103 |
| 5,790,359 | A * | 8/1998 | Kapp et al. | 361/106 |
| 5,816,493 | A * | 10/1998 | Pirkle | 236/101 R |
| 5,831,507 | A * | 11/1998 | Kasamatsu et al. | 337/4 |
| 6,088,234 | A * | 7/2000 | Ishikawa et al. | 361/760 |
| 6,211,770 | B1 * | 4/2001 | Coyle | 338/21 |
| 6,430,019 | B1 * | 8/2002 | Martenson et al. | 361/124 |
| 6,445,277 | B1 * | 9/2002 | Ishikawa et al. | 337/297 |
| 6,504,467 | B1 * | 1/2003 | Berberich et al. | 337/139 |
| 6,583,711 | B2 * | 6/2003 | Yang | 337/394 |
| 6,717,090 | B2 * | 4/2004 | Kling et al. | 218/151 |
| 7,411,769 | B2 | 8/2008 | Schimanski et al. | |
| 7,477,503 | B2 * | 1/2009 | Aszmus | 361/124 |
| 7,483,252 | B2 * | 1/2009 | de Palma et al. | 361/127 |
| 7,684,166 | B2 * | 3/2010 | Donati et al. | 361/118 |
| 7,728,709 | B2 * | 6/2010 | Grunbichler et al. | 337/4 |
| 7,839,257 | B2 * | 11/2010 | Cernicka | 337/206 |
| 7,864,024 | B2 * | 1/2011 | Schlenker et al. | 337/407 |
| 8,089,745 | B2 | 1/2012 | Wosgien | |
| 8,179,652 | B2 * | 5/2012 | Depping et al. | 361/103 |
| 8,335,069 | B2 * | 12/2012 | Tegt et al. | 361/127 |
| 8,477,469 | B2 * | 7/2013 | Depping et al. | 361/127 |
| 8,665,057 | B2 * | 3/2014 | Schlenker et al. | 337/407 |
| 8,705,221 | B2 * | 4/2014 | Daum | 361/118 |
| 8,816,390 | B2 * | 8/2014 | Marbella et al. | 257/173 |
| 2006/0245125 | A1 * | 11/2006 | Aszmus | 361/56 |
| 2009/0316319 | A1 * | 12/2009 | Depping et al. | 361/91.1 |
| 2011/0026184 | A1 * | 2/2011 | Tegt et al. | 361/118 |
| 2011/0032651 | A1 * | 2/2011 | Depping et al. | 361/91.1 |
| 2011/0194222 | A1 * | 8/2011 | Durth et al. | 361/91.1 |
| 2012/0068806 | A1 * | 3/2012 | Guarniere et al. | 337/1 |

FOREIGN PATENT DOCUMENTS

| | | | |
|---|---|---|---|
| DE | 37 10 359 | A1 | 10/1988 |
| DE | 42 41 311 | A1 | 6/1994 |
| DE | 196 26 275 | A1 | 1/1998 |
| DE | 695 03 743 | T2 | 3/1999 |
| DE | 699 04 274 | T2 | 8/2003 |

* cited by examiner

OVERVOLTAGE PROTECTION ELEMENT

BACKGROUND OF THE INVENTION

1. Field of the Invention

The invention relates to an overvoltage protection element with a housing, with at least one overvoltage limiting component which is located in the housing, especially a varistor or a gas filled surge arrester, and with at least two connection elements for electrical connection of the overvoltage protection element to the current path or signal path which is to be protected, in the normal state of the overvoltage protection element the connection elements each being in electrical contact with one pole of the overvoltage limiting component at a time.

2. Description of Related Art

German Patent Application DE 42 41 311 A1 discloses an overvoltage protection element which has a thermal disconnector for monitoring of the state of a varistor. In this overvoltage protection element, the first connection element is connected via a flexible conductor to a rigid isolating element whose end facing away from the flexible conductor is connected via a solder site to a terminal lug which is provided on the varistor. The other connection element is tightly connected to the varistor or a terminal lug on the varistor via a flexible conductor. The isolating element is exposed to a force from a spring system which leads to the isolating element being moved linearly away from the terminal lug when the solder connection is broken so that the varistor is electrically disconnected when thermally overloaded. When the solder connection is broken a telecommunications contact is actuated at the same time via the spring system, as a result of which remote monitoring of the state of the overvoltage protection element is possible.

German Utility Model DE 20 2004 006 227 U1 and corresponding U.S. Pat. No. 7,411,769 B2 disclose an overvoltage protection element in which the state of a varistor is monitored according to the principle of a temperature switch so that when the varistor overheats a solder connection provided between the varistor and the interrupting element is broken; this leads to electrical isolation of the varistor. Moreover, when the solder connection is broken a plastic element is pushed by the reset force of a spring out of a first position into a second position in which the isolating element which is made as an elastic metal tongue is separated thermally and electrically from the varistor by the plastic element so that an arc which may arise between the metal tongue and the contact site of the varistor is extinguished. Since the plastic element has two colored markings located next to one another, it acts additionally as an optical state display, as a result of which the state of the overvoltage protection element can be read directly on site.

German Patent DE 699 04 274 T2 likewise discloses an overvoltage protection element with a thermal disconnection mechanism. In this overvoltage protection element one end of a rigid, spring-loaded slide in the normal state of the overvoltage protection element is soldered to the first connection element and also to the terminal lug which is connected to the varistor. Unacceptable heating of the varistor here also leads to heating of the solder site so that the slide is pulled out of the connection site between the first connection element and the terminal lug as a result of the force of a spring acting on it; this leads to electrical disconnection of the varistor.

German Patent DE 695 03 743 T2 discloses an overvoltage protection element with two varistors, which has two isolating means which can disconnect the varistors each individually on their live end. The isolating means each have an elastic isolating tongue, the first end of the isolating tongue being tightly connected to the first terminal and the second end of the isolating tongue being attached to a connecting tongue on the varistor in the normal state of the overvoltage protection element via a solder site. If unacceptable heating of the varistor occurs, this leads to melting of the solder connection. Since the isolating tongue in the soldered-on state (normal state of the overvoltage protection element) is deflected out of its rest position and is thus pretensioned, the free end of the isolating tongue springs away from the connecting tongue of the varistor when the solder connection softens, as a result of which the varistor is electrically disconnected. In order to ensure the required insulation resistance and resistance to creepage and to extinguish an arc which forms when the isolation site opens, it is necessary that when the isolating tongue is pivoted a distance as great as possible between the second end of the isolating tongue and the connecting tongue of the overvoltage limiting component is achieved.

The known overvoltage protection elements are generally made as "protective plugs" which together with a lower part of the device form an overvoltage protection device. For installation of such an overvoltage protection device which, for example, is designed to protect the phase-carrying conductors L1, L2, L3 and the neutral conductor N and optionally also the ground conductor PE, in the known overvoltage protection devices there are the corresponding terminals for the individual conductors on the lower part of the device. For simple mechanical and electrical contact-making of the lower part of the device with the respective overvoltage protection element, in the overvoltage protection element the connection elements are made as plug pins for which there are corresponding receptacles which are connected to the terminals in the lower part of the device so that the overvoltage protection element can be slipped onto the lower part of the device.

In these overvoltage protection devices, the installation and mounting can be done very easily in a time-saving manner by the intermateability of the overvoltage protection elements. In addition these overvoltage protection devices in part have a changeover contact as a primary detector for remote reporting of the state of at least one overvoltage protection element and an optical state display in the individual overvoltage protection elements. It is displayed via the state display whether the overvoltage limiting component located in the overvoltage protection element is still serviceable or not. Here, especially varistors are used as the overvoltage limiting component, but depending on the purpose of the overvoltage protection element also gas-filled surge arresters, spark gaps or diodes can be used.

The above described thermal disconnection devices which are used in the known overvoltage protection elements and which are based on the melting of a solder connection must perform several tasks. In the normal state of the overvoltage protection element, i.e., in the unisolated state, a reliable and good electrical connection must be ensured between the first connection element and the overvoltage limiting component. When a certain boundary temperature is exceeded the isolating point must ensure reliable disconnection of the overvoltage limiting component and continuous insulation resistance and resistance to creepage. But, the problem is that the solder connection is continuously loaded with a shear stress in the normal state of the overvoltage protection element as a result of the spring force of the spring element or the isolating tongue which has been deflected out of its rest position.

SUMMARY OF THE INVENTION

Therefore, the object of this invention is to provide an overvoltage protection element of the initially described type in which the aforementioned disadvantages are avoided.

Here, both a reliable and good electrical connection in the normal state as well as reliable disconnection of a defective overvoltage limiting component are to be ensured.

This object is achieved in an overvoltage protection element of the initially described type in that there is a thermally expandable material within the housing such that, when the overvoltage limiting component is thermally overloaded, the position of the overvoltage limiting component can be changed relative to the position of the connection elements as a result of expansion of the thermally expandable material such that at least one pole of the overvoltage limiting component is no longer in electrical contact with the corresponding connection element.

The thermally expandable material, which is composed preferably of a low melting point plastic, for example, polyethylene (PE) or polypropylene (PP), and a propellant that is in a solid state in the normal state of the overvoltage protection element. If the temperature of the thermally expandable material rises as a result of increased inherent heating of the overvoltage limiting component, the thermally expandable material changes its aggregate state and becomes liquid. After exceeding a certain boundary temperature, the thermally expandable material reacts with the propellant and experiences a large increase of volume, i.e., the thermally expandable material foams up. This large volume increase of the thermally expandable material which is caused by the temperature rise is used in the overvoltage protection element in accordance with the invention to move the overvoltage limiting component away from the connection elements so that the overvoltage limiting component is electrically disconnected.

Since the thermally expandable material is activated only when heated accordingly, i.e., in thermal overloading of the overvoltage limiting component, the electrical contact between the connection elements and the poles of the overvoltage limiting component in the normal state is not mechanically stressed by the thermally expandable material.

According to one configuration of the overvoltage protection element in accordance with the invention, the electrical contact between the connection elements and the poles of the overvoltage limiting component—as is fundamentally known from the prior art—is implemented via a solder connection. For this purpose, in the normal state of the overvoltage protection element, the poles of the overvoltage limiting component are each connected to the connection elements via a solder site. Here, the solder connection breaks when the temperature of the overvoltage limiting component exceeds a given boundary temperature at which the force acting on the overvoltage limiting component by the expanding material is greater than the still remaining holding force of the solder sites.

According to one preferred configuration of the overvoltage protection element in accordance with the invention, however, instead of a solder connection, a surge current capable plug connection is provided. For this purpose, in the normal state of the overvoltage protection element, the two poles of the overvoltage limiting component are connected to a connection element via a respective plug connection. Here, the thermally expandable material which is located within the housing performs both the function of a sensor which detects an impermissible inherent heating of the overvoltage limiting component, and also the function of an actuator which moves the overvoltage limiting component away from the connection elements in response to thermal overloading. In contrast, in the known overvoltage protection elements which are based on melting of a solder connection, the function of the sensor is assumed by the solder site and the function of the actuator by the spring or the isolating means which has been deflected out of its rest position.

Fundamentally, it is also possible for one pole of the overvoltage limiting component to be connected to a connection element via a solder site, while the other pole is connected, for example, via a plug connection or a flexible conductor to the second connection element. Likewise, it is also possible that, in the normal state of the overvoltage protection element, one pole of the overvoltage limiting component is connected via a plug connection to a connection element while the other pole is connected to the other connection element via a flexible conductor. If one pole of the overvoltage limiting component is connected via a flexible conductor to a connection element, this leads to only one pole no longer being in electrical contact with the corresponding connection element when the position of the overvoltage limiting component changes due to expansion of the thermally expandable material; but, this likewise leads to the overvoltage limiting component being electrically disconnected.

Advantageously, the overvoltage protection element in accordance with the invention is, however, made such that the two poles are isolated from the connection elements upon thermal overloading of the overvoltage limiting component so that, after completed disconnection, the two poles of the overvoltage limiting component are no longer in electrical contact with the connection elements. By forming two isolating points, the extinguishing of an arc which may occur is promoted since the two isolating points form a series connection so that the entire arc length, and thus, also the arc braking voltage, are increased by the series connection of the two isolating points. In this case, it is advantageous if, as stated above, the two poles of the overvoltage limiting component are connected via a plug connection to each connection element since, then, the disconnection of the electrical connection depends, first of all, on the temperature behavior of the thermally expandable material and not (also) on the disconnection behavior of a solder site.

According to another advantageous embodiment of the overvoltage protection element in accordance with the invention, the two poles of the overvoltage limiting component are each electrically connected conductively to a terminal lug or terminal post. Both the solder connections, and also, the plug connections between the poles of the overvoltage limiting component and the connection element can be easily implemented by the execution of the terminal lugs or terminal posts. In the former case, the solder sites are each provided between a terminal lug or a terminal post and a connection element, while for a plug connection, the connection elements on the side facing the terminal lugs or the terminal posts have receptacles.

According to an advantageous mechanical embodiment of the invention, the housing has an outer housing and an inner housing which is open on one side and which is located in the outer housing, the inner housing being movable relative to the outer housing. The connection elements are fixedly connected to the outer housing while the overvoltage limiting component is located within the inner housing. In the normal state of the overvoltage protection element, the hood-shaped inner housing surrounds the thermally expandable material such that the inner housing with the overvoltage limiting component is shifted when the thermally expandable material expands relative to the outer housing—and thus, also relative to the two connection elements. Due to the thermally expandable material which has been activated as a result of the heating of the overvoltage limiting component, the inner housing together with the overvoltage limiting component which is located in it is, thus, forced away from the connection elements so that the poles of the overvoltage limiting component are no longer in electrical contact with the connection elements.

In order to ensure that, when the inner housing is displaced, the overvoltage limiting component is also displaced, the overvoltage limiting component is preferably connected to the inner housing via a holding element. This holding element can be web-shaped with ends thereof attached to the inner wall of the housing so that it extends in the transverse direction of the overvoltage limiting component.

According to a preferred configuration of an overvoltage protection element in accordance with the invention with an outer housing and an inner housing which is arranged to be able to move in the outer housing, the position change of the inner housing is used for optical display of the state of the overvoltage limiting component. For this purpose, the inner housing has a first position within the outer housing in the normal state of the overvoltage protection element such that the top of the inner housing does not project beyond the top of the outer housing. In thermal overloading of the overvoltage protection element, the inner housing is conversely shifted due to the expanding material into a second position in which the top of the inner housing projects above the top of the outer housing. The displacements of the inner housing in thermal overloading of the overvoltage protection element are thus used for displaying the functional status of the overvoltage protection element.

According to an advantageous mechanical embodiment of the overvoltage protection element in accordance with the invention, the housing has two electrically conductive holding elements which are isolated from one another. In the normal state of the overvoltage protection element, each of the holding elements is in electrical contact with one pole or one terminal post or one terminal lug of the overvoltage limiting component. Here, the holding elements surround the thermally expandable material so that the overvoltage limiting component, when unacceptably heated, is displaced by the expanding material relative to the holding elements. The overvoltage limiting component is then no longer in electrical contact with the holding elements and is electrically disconnected. In this version, the electrically conductive holding elements are used both as a housing for accommodating the overvoltage limiting component and the thermally expandable material and also as connection elements for electrical connection of the poles of the overvoltage limiting component.

The electrical contact between the poles or the terminal lugs or terminal posts of the surge arrester which are connected to the poles and the holding elements which are being used as connection elements can be implemented both via a solder connection and also via a plug connection, and in the implementation of a plug connection in the connection region of the holding elements, there can be receptacles corresponding to the terminal lugs or the terminal posts. This overvoltage protection element is especially suitable when using a gas-filled surge arrester as overvoltage limiting component, and the surge arrester can be connected, for example, to a circuit board via the two holding elements.

Depending on the holding elements and depending on the arrangement of the overvoltage limiting component and of the thermally expandable material between the holding elements, the overvoltage limiting component in thermal overloading is pressed either up, perpendicular to its longitudinal extension, or horizontally to the side by the expanding material. Of course, a configuration is also possible in which the overvoltage limiting component is pressed both up and also to the side by the expanding material. In any case, the expansion of the thermally expandable material and the resulting change in the position of the overvoltage limiting component provide for the poles of the overvoltage limiting component to no longer be in electrical contact with the holding elements.

In order to ensure the required insulation resistance and resistance to creepage and to extinguish an arc which forms when the contacts open between the poles of the overvoltage limiting component and the connection elements, in the prior art, a distance as large as possible between the poles and the terminal lugs of the overvoltage limiting component and the connection elements must be achieved. In the overvoltage protection element in accordance with the invention, it is provided, according to an advantageous configuration, that the thermally expandable material in thermal overloading of the overvoltage limiting component penetrates into the intermediate space which is forming between at least one pole and terminal lug or terminal post of the overvoltage limiting component and at least one connection element so that an arc which forms when the electrical contact is broken is suppressed or extinguished by the insulating thermally expandable material. Alteratively or in addition, in the region of the connection elements, there can be at least one plastic part, for example, of POM, which evolves gas when heated. If an arc arises in the vicinity of the plastic part, it is extinguished by blowing an extinguishing gas which is produced via the dissociation of the plastic part.

According to another advantageous configuration of the overvoltage protection element in accordance with the invention, which will be briefly mentioned here, alteratively or in addition to the above described optical state display, a remotely transmitted state display is provided, for which there is a telecommunications contact within the housing which is activated when the position of the overvoltage limiting component is changed by the expanding material.

The thermally expandable material which is used in the overvoltage protection element in accordance with the invention preferably has an activation temperature which is more than 80° C. Preferably the activation temperature of the thermally expandable material, i.e., the temperature at which the material expands, is between 120° C. and 150° C. Thus, the activation temperature of the thermally expandable material is optimally matched to the maximum allowable operating temperature of the overvoltage protection element which is often roughly 80° C.

As already mentioned, the overvoltage limiting component will be moved away from its first position by the thermally expandable material. Thus, a distinct expansion of the material is desirable when its activation temperature has been reached. The increase in the volume of the thermally expandable material is preferably at least 200 percent, i.e., at least twice the volume of the thermally expandable material before its activation. Since, in the case of an overload, a rapid disconnection of the overvoltage limiting component is necessary, the thermally expandable material is preferably made such that it has a reaction time of less than one second for activation.

In order to achieve the aforementioned boundary conditions, i.e., the desired activation temperature, the increase of volume and the reaction time, the thermally expandable material preferably is composed of a carrier material and a propellant. The carrier agent can be especially a thermoplastic polymer which is preferably selected from the following group: acrylonitrile-butadiene-styrene (ABS), polyamides (PA), polyacetate (PLA), polycarbonate (PC), polymethylmethacrylate (PMMA), polyethylene terephthalate (PET), and polyolefines, such as, for example, polyethylene (PE), polypropylene (PP), polyisobutylene (PIB), polybutylene (PB), polystyrene (PS), polyetheretherketone (PEEK), polyvinyl chloride (PVC), polybutylene terephthalate (PBT) and celluloid. Alternatively, an elastomer with a low Shore hardness can be used as the carrier material, the Shore hardness being preferably less than 20.

The propellant can be either a chemically acting propellant or a physically acting propellant. According to a preferred configuration, a physically acting propellant is used which is comprised of extremely small hollow bodies which are filled with gases which are in the liquid phase. This propellant is also called a microsphere. The size of the hollow bodies is in the one to two digit micron range. The jacket of the bodies is diffusion-tight and rigid below the activation temperature, but elastic when the activation temperature is reached. A temperature rise causes a phase change of the liquid within the hollow bodies from liquid to gas; this change leads to a very dramatic increase in volume. The activation temperature can be set by the suitable choice of the liquid or gas so that the propellant can be matched to the respective application.

The proportion of propellant is preferably roughly 5 to 15% relative to the carrier material. At this mixing ratio, a relatively good and practical increase in the volume of the thermally expandable material composed of the carrier material and the propellant is achieved. Altogether, a volume increase by a factor of 5 can be achieved.

The carrier material is chosen such that its softening temperature is on the order of the activation temperature of the propellant. In this respect, polyethylene (PE) and polypropylene (PP) are especially well suited as the carrier material. Depending on the application, the carrier material or the propellant is chosen such that the activation temperature of the propellant is greater than or less than the softening temperature of the carrier material. For applications which require the disconnection of a component as fast as possible or the actuation of a switch, it is advantageous if the activation temperature of the propellant is somewhat less than the softening temperature of the carrier material. This then leads to the propellant beginning its reaction before the softening temperature of the carrier material is reached. In this way, pre-tensioning is built up in the thermally expandable material; this leads to a very rapid increase in volume when the softening temperature is reached.

If a carrier material and a propellant are chosen for which the activation temperature of the propellant is greater than the softening temperature of the carrier material, this then leads to the carrier material already softening before the propellant reacts so that the volume increase of the material begins with reaching the activation temperature and ends when the maximum volume increase is reached or the activation temperature is again not reached. The process proceeds much more slowly than in the case in which the activation temperature is less than the softening temperature. This slow progression of the process is suitable, for example, for changing an optical state display. To change an optical state display by the volume increase of a thermally expandable material, a material combination of propellants with different activation temperatures can be used, as a result of which a gradual change of the state display depending on the temperature which has occurred at the time is possible.

According to an alternative configuration, the thermally expandable material is formed of two components which are separated from one another in the unactivated state, the components reacting with one another with a resulting increase in their volume when the separation is neutralized. The two components can be, for example, sodium hydrogen carbonate on the one hand and an acid, for example, citric acid, on the other, which are first separated from one another by a separating layer. When the separation is neutralized, for example, by mechanical or thermal action, the two components react with one another, gas being released; this leads to a volume increase. Similar reactions are also attainable with multiple components, polyurethanes or by means of fast oxidation, for example, when a combustion process is ignited.

Generally, the thermally expandable material is made such that the volume increase is irreversible. But, a suitable choice of the propellant and carrier material can also result in that the carrier material, upon cooling, being transferred back into its initial state so that the volume increase of the material can be made reversible.

Since the activation of the thermally expandable material and especially of the propellant is dependent on the addition of heat to the thermally expandable material, good thermal coupling to the overvoltage limiting component which is to be monitored is necessary. In order to increase or improve the delivery of heat into the thermally expandable material, active heating by additional energy delivery into the material from the outside can be provided.

For this purpose, a heating resistor can be embedded in the thermally expandable material, for example, whose own heat loss release leads to additional heating of the material. Alternatively, a heat pipe or a conductor with high thermal conductivity, for example, of copper, can be embedded in the material. Finally, additional heating of the thermally expandable material can also be achieved in by conductive components, such as, for example, graphite powder or copper powder, being added to the material. In this way, an inherent conductivity of the material is achieved so that the material is heated throughout its volume when a voltage is present by the current flowing through the material. With the increase in the volume of the material, which begins when the activation temperature is reached, the resistance increases since the number of conductive components per unit of volume is reduced. Preferably, a complete cessation of the current flow occurs, as a result of which the additional heat delivery is shut off.

In addition to the above described overvoltage protection element, the invention also relates to the use of a thermally expandable material as a material for detecting unacceptable heating of an electrical or electronic component, as a result of overloading or aging of the component, the thermally expandable material expanding when heated above a certain activation temperature and the electrical power supply of the component being interrupted by the expansion of the thermally expandable material. The component is preferably an overvoltage limiting component in an above described overvoltage protection element.

In particular, there is now a host of possibilities for embodying and developing the overvoltage protection element in accordance with the invention. In this regard, reference is made to the following description of preferred exemplary embodiments in conjunction with the accompanying drawings.

DETAILED DESCRIPTION OF THE INVENTION

The figures show an overvoltage protection element 1 with a housing 2, and an overvoltage limiting component located in the housing 2. In the exemplary embodiment according to FIGS. 1 to 3, the overvoltage limiting component is a varistor 3, while the overvoltage protection elements 1 according to FIGS. 4 to 12 use a gas-filled surge arrester 3'.

Figure 1:
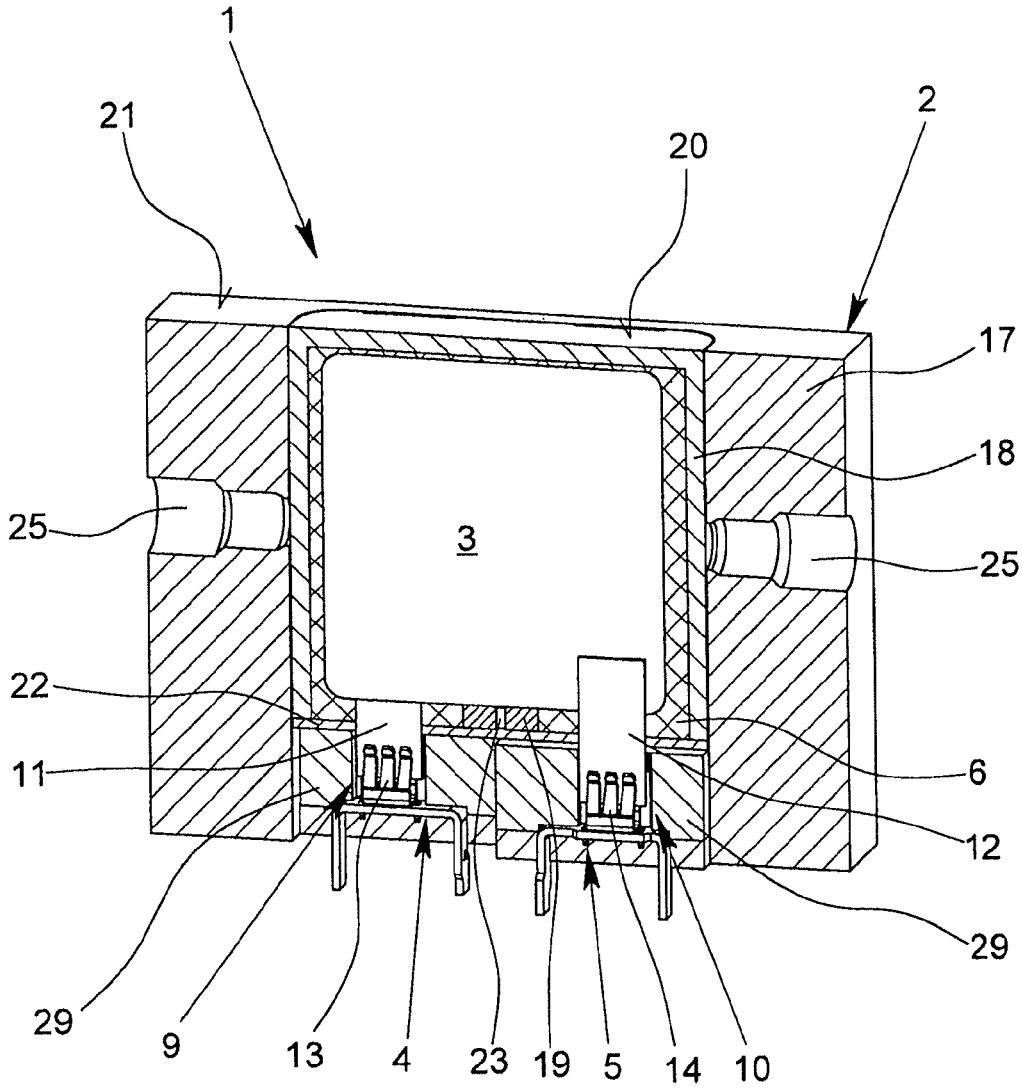
FIG. 1 shows a section of a first exemplary embodiment of an overvoltage protection element, in the normal state.
Figure 2:
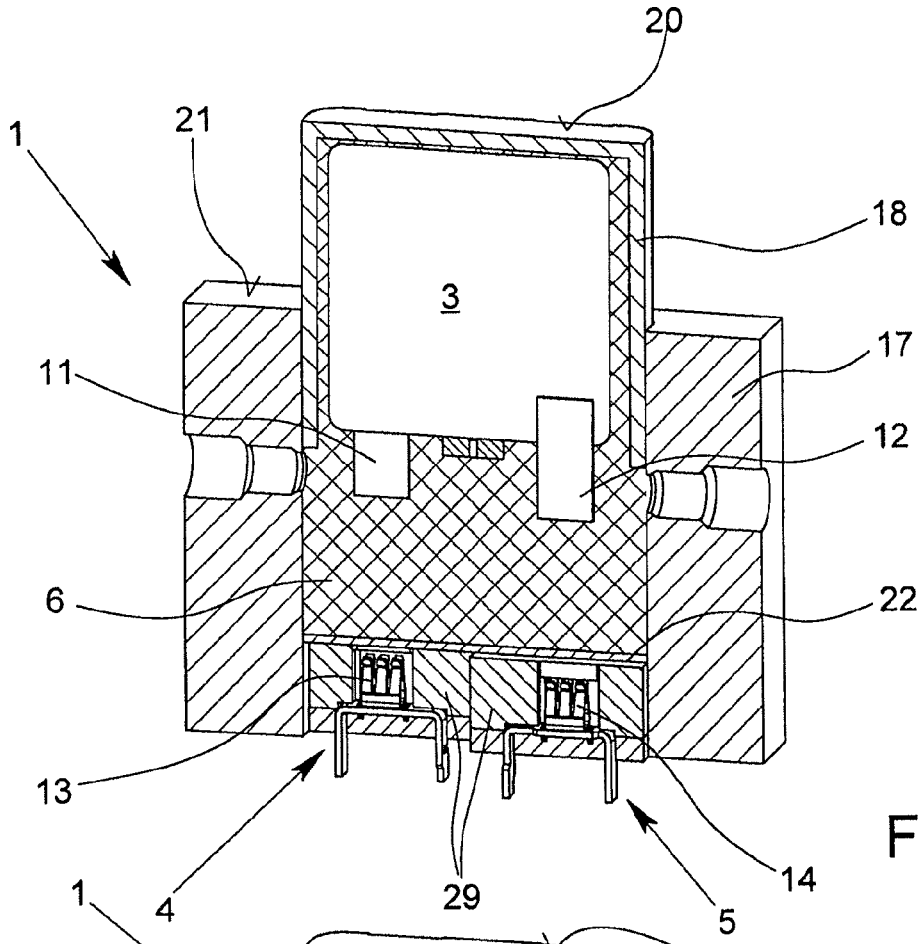
FIG. 2 shows a section of the overvoltage protection element according to FIG. 1, with a disconnected varistor.
Figure 3:
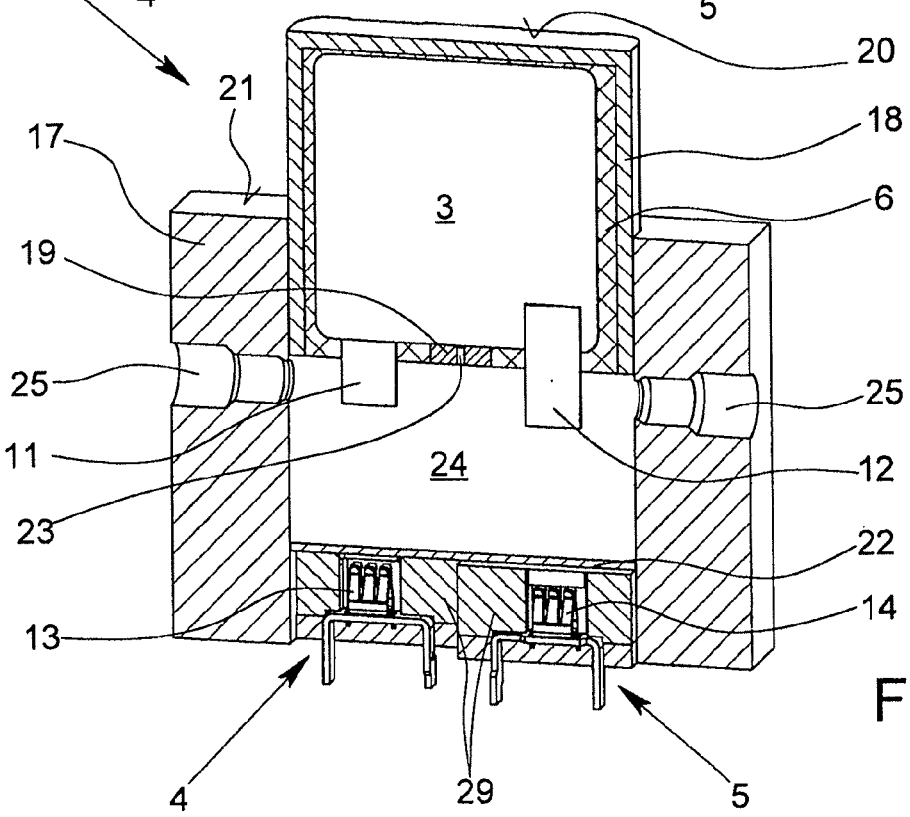
FIG. 3 shows another section of an overvoltage protection element according to FIG. 1, with a disconnected varistor.

The overvoltage protection element 1 according to FIGS. 1 to 3 can be made as a protective plug having two connection elements 4, 5 which can be inserted into corresponding receptacles of the lower part of a device (not shown). The connection elements 4, 5 are each connected to a pole of the varistor 3 in the normal state of the overvoltage protection element 1 so that the varistor 3 can be connected via the two connection elements 4, 5 to the current path or signal path which is to be protected.

Figure 4:
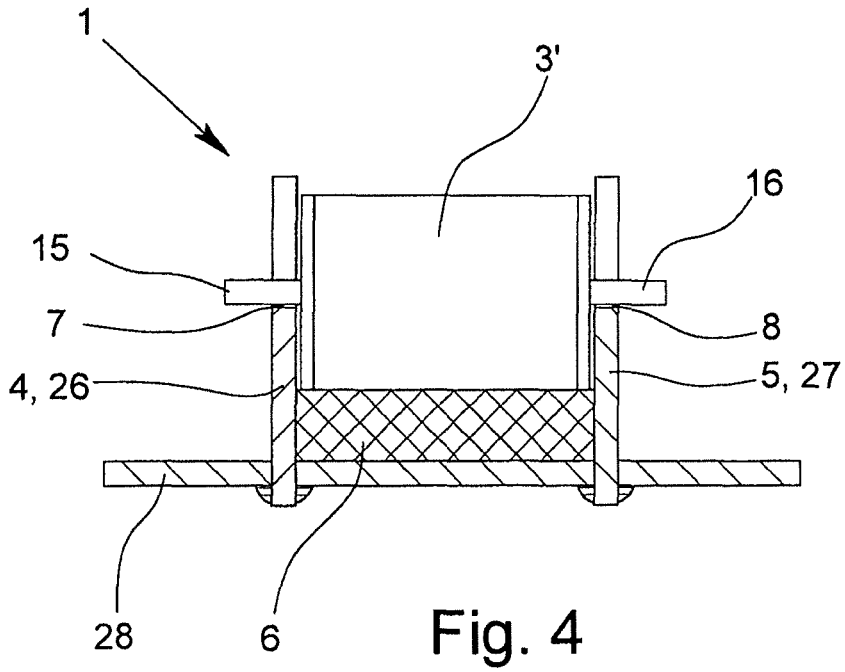
FIG. 4 shows a section of a second exemplary embodiment of an overvoltage protection element, in the normal state.
Figure 6:
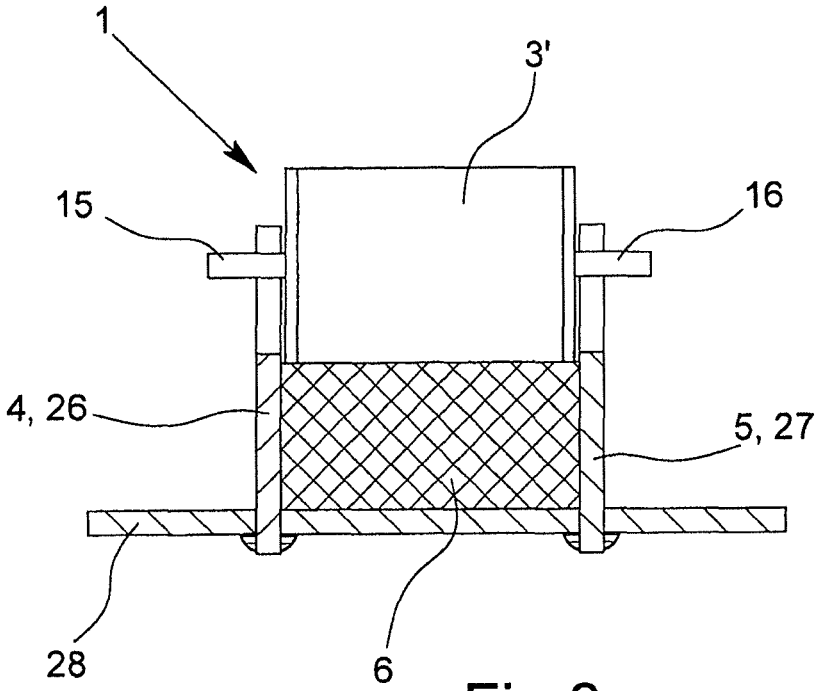
FIG. 6 shows a section of the overvoltage protection element according to FIG. 4, with a disconnected surge arrester.
Figure 7:
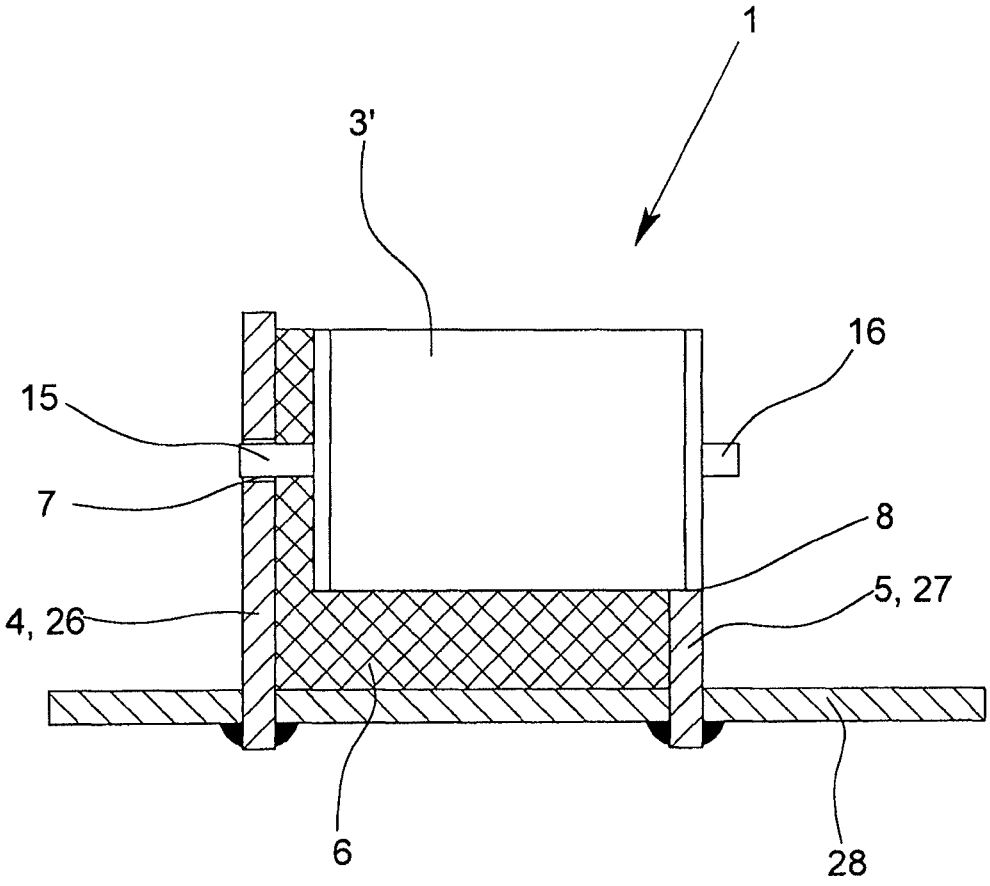
FIG. 7 shows a section of a third exemplary embodiment of an overvoltage protection element, in the normal state.

As is apparent from FIGS. 1, 4 and 7, in the normal state of the overvoltage protection element 1, a thermally expandable material 6 is located in the housing 2. The thermally expandable material 6 can be, for example, an intumescent material, which material is first solid, but as the temperature rises, changes its aggregate state and becomes liquid. When an activation temperature is exceeded, the thermally expandable material 6 reacts with a dramatic increase in volume, i.e., the material 6 foams up and expands. This then leads to the position of the varistor 3 or of the surge arrester 3' changing relative to the position of the connection elements 4, 5 since the thermally expandable material 6 forces the varistor 3 or surge arrester 3' out of its first position. In the exemplary embodiments according to FIGS. 2 & 6, the varistor 3 or the surge arrester 3' has been forced up, or to the side in the exemplary embodiment according to FIG. 9.

The overvoltage protection element 1 according to FIGS. 1 to 3, on the one hand, and the overvoltage protection elements 1 according to FIGS. 4 to 12, on the other, differ from one another, first of all, in that, in the first exemplary embodiment, the overvoltage limiting component is a varistor 3, while in the other exemplary embodiments a gas-filled surge arrester 3' is used. Moreover, the overvoltage protection elements 1 differ by the type of electrical contact-making between the varistor 3 and the connection elements 4, 5, on the one hand, and the surge arrester 3' and the connection elements 4, 5, on the other.

While in the two exemplary embodiments according to FIGS. 4 & 7, in the normal state of the overvoltage protection element 1, the two poles of the surge arrester 3' are connected via a respective solder site 7, 8 to the connection elements 4, 5, so that the poles of the varistor 3 are in electrical contact via a plug connection 9, 10 to the two connection elements 4, 5. The two poles of the varistor 3 are connected via two terminal lugs 11, 12 to the connection elements 4, 5, the connection elements 4, 5 each having a receptacle 13, 14 on the sides facing the terminal lugs 11, 12. In the exemplary embodiment of the overvoltage protection element 1 shown in FIG. 4, each of the two poles of the surge arrester 3' are connected to a respective terminal post 15, 16 so that the solder sites 7, 8 are formed between the terminal posts 15, 16 and the connection elements 4, 5.

In the exemplary embodiment of the overvoltage protection element 1 in accordance with the invention according to FIGS. 1 to 3, the housing 2 has an outer housing part 17 and an inner housing part 18 which is arranged to be able to move in the outer housing part 17. As is apparent from the figures, the bottom of the inner housing part 18 is open so that the inner housing part 18 surrounds the varistor 3 and the thermally expandable material 6 in the manner of a hood. If the impedance of the varistor 3 is reduced as a result of overloading or as a result of aging of the varistor 3, an impermissible leakage current flows through the varistor 3; this leads to heating of the varistor 3. Since the varistor 3 is at least partially surrounded by the thermally expandable material 6, inherent heating of the varistor 3 also leads to heating of the material 6 so that it dramatically expands when a certain activation temperature is exceeded. This leads to a pressure increase within the space which is surrounded by the outer housing part 17 and the inner housing part 18 so that the inner housing part 18 is forced up by the expanding material 6 when the holding force of the inner housing part 18 within the outer housing part 17 and the contact force between the terminal lugs 11, 12 and the receptacles 13, 14 are exceeded by the force of the expanding material 6.

So that the varistor 3 also moves up with the inner housing part 18, the varistor 3 is connected to the inner housing part 18 via a holding element 19, the holding element 19 being located underneath the varistor 3 and extending perpendicular to the plane of the drawings, i.e., in the transverse direction of the varistor 3, according to FIGS. 1 to 3. The inner housing part 18 is thus guided like a piston in the outer housing 17, a stop which is not shown in the figures providing a limit to the motion of the inner housing part 18 out of the outer housing part 17.

As is apparent from FIG. 1, the inner housing part 18, in the normal state of the overvoltage protection element 1, is in a first position within the outer housing part 17 in which the top 20 of the inner housing part 18 ends essentially flush with the top 21 of the outer housing part 17 so that the top 20 of the inner housing part 18 does not project beyond the end of the outer housing 17. In contrast thereto, in the case of thermal overloading of the overvoltage protection element 1, after electrical disconnection of the varistor 3, the inner housing part 18 is located in a second position (FIG. 2) in which the top 20 of the inner housing part 18 projects over the top 21 of the outer housing 17. The position of the inner housing part 18 is thus used as an optical status display for displaying the state of the overvoltage protection element 1.

It was stated above that the thermally expandable material 6 is preferably an intumescent material which in the normal state of the overvoltage protection element 1 is solid and first becomes liquid when the temperature rises. In order to reliably prevent discharge of the liquid intumescent material 6, in the illustrated exemplary embodiment above the connection elements 4, 5, i.e., opposite the open bottom of the inner housing 18, there is a sealing film 22 in the outer housing 17. Here the terminal lugs 11, 12 in the normal state of the overvoltage protection element 1 extend through slots provided in the sealing film 22 so that the terminal lugs 11, 12 make contact with the receptacles 13, 14 and thus are in electrical contact with the connection elements 4, 5.

FIG. 3 shows the overvoltage protection element 1 according to FIG. 1, in which the inner housing part 18 is in the second position so that the varistor 3 is disconnected. In contrast to the representation according to FIG. 2, in the representation according to FIG. 3, the varistor 3 or the inner housing part 18 has been shifted upward, not by an expansion of the thermally expandable material 6, but as a result of an overpressure which has been caused by bursting of the varistor 3 due to an extreme overload. Extreme overloading can shift a varistor 3 suddenly into a low-impedance state so that, in this extreme case, a grid-driven current of the size of the short circuit current can flow through the varistor 3. A current flowing through the varistor 3 in this case can lead to destruction and thus to bursting of the varistor 3. The resulting pressure is routed via an opening 23 which is formed in the holding element 19 which is located under the varistor 3 into the space 24 which is formed by the outer housing 17, the inner housing part 18 and the sealing film 22. The pressure which arises in this space 24 can lead to the inner housing part 18 being forced upward out of its first position into its second position, as a result of which the varistor 3 is also moved away from the connection elements 4, 5 so that the terminal lugs 11, 12 are no longer in electrical contact with the receptacles 13, 14. The overloaded varistor 3 is thus reliably and quickly disconnected.

In the position of the inner housing part 18 which is shown in FIG. 3, the increased pressure which prevails in the space 24 can escape through the openings 25 formed in the outer housing 17. The openings 25 are located in the outer housing part 17 such that they are closed by the inner housing part 18 as long as the inner housing part 18 is not yet in its second position.

In the exemplary embodiment of the overvoltage protection element 1 shown in FIG. 4, the housing 2 does not comprise an outer housing and an inner housing, but instead is formed of two holding elements 26, 27 which are U-shaped in cross section and which are used, in addition, to accommodate the thermally expandable material 6, as well as for holding and contact-making of the terminal posts 15, 16 of the surge arrester 3' in the normal state of the overvoltage protection element 1. In the exemplary embodiments of the overvoltage protection element 1 which are shown in FIGS. 4 to 12, the two electrically conductive holding elements 26, 27 are isolated from one another are thus used as connection elements 4, 5 for the gas-filled surge arrester 3'. FIG. 4 shows that, in the normal state of the overvoltage protection element 1, each solder site 7, 8 is formed between the two terminal posts 15, 16 and the holding elements 26, 27.

In this overvoltage protection element 1, if the surge arrester 3' is heated, this also leads to heating of the thermally expandable material 6 which is located underneath the surge arrester 3' so that it expands when its activation temperature is reached. The surge arrester 3' is then forced upward when the force applied by the thermally expandable material 6 is greater than the holding force of the softening solder sites 7, 8. In this second position of the surge arrester 3' shown in FIG. 6, the two terminal posts 15, 16 are no longer in electrical contact with the holding elements 26, 27 so that the surge arrester 3' is no longer connected to the signal path which is to be protected via the holding elements 26, 27. The electrical connection of the holding elements 26, 27 to the signal path which is to be protected takes place in the exemplary embodiments according to FIGS. 4 to 12 by the holding elements 26, 27 being connected to a circuit board 28.

Instead of the solder connection shown in the figures between the terminals posts 15, 16 and the holding elements 26, 27, fundamentally, there can also be a plug connection according to FIGS. 1 to 3. In this case, the holding elements 26, 27 would have corresponding receptacles on the sides facing the terminal posts 15, 16.

Figure 5:
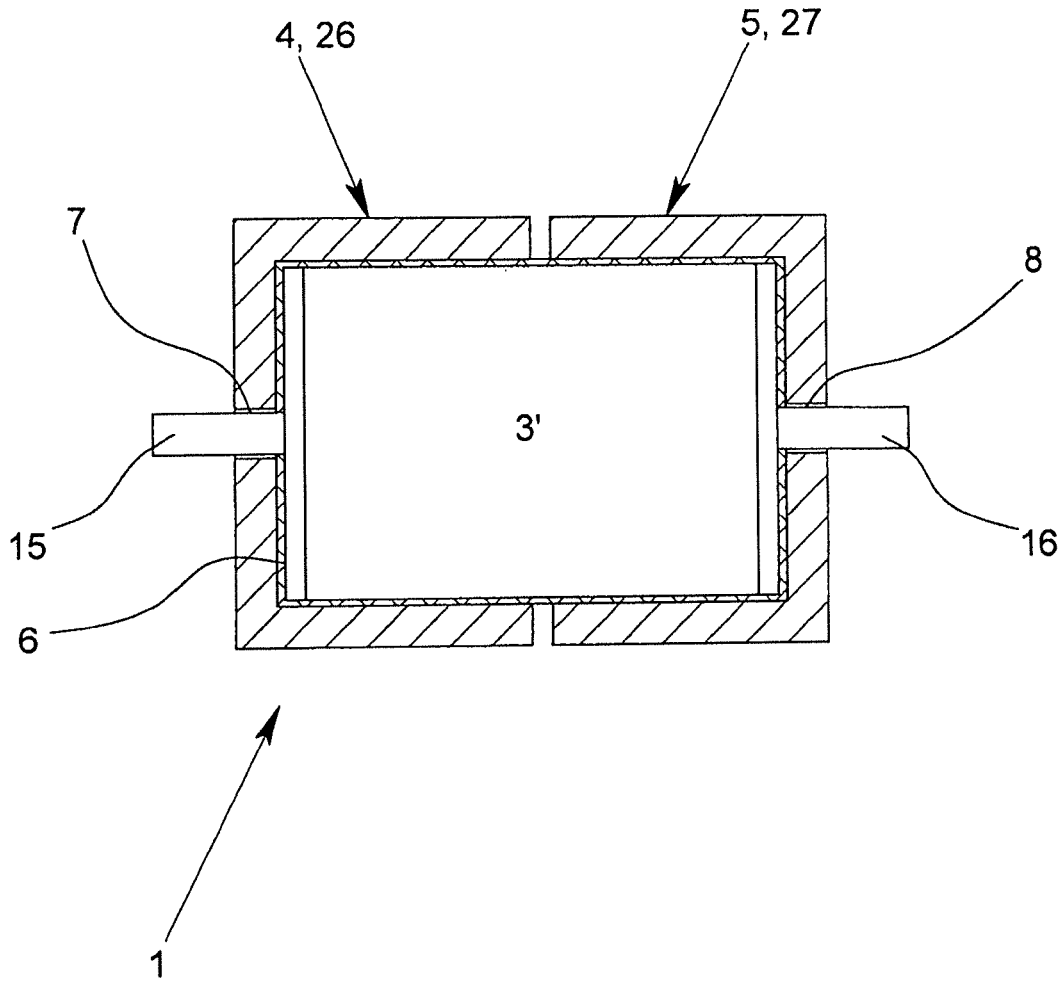
FIG. 5 shows a plan view of the overvoltage protection element according to FIG. 4, in the normal state.
Figure 8:
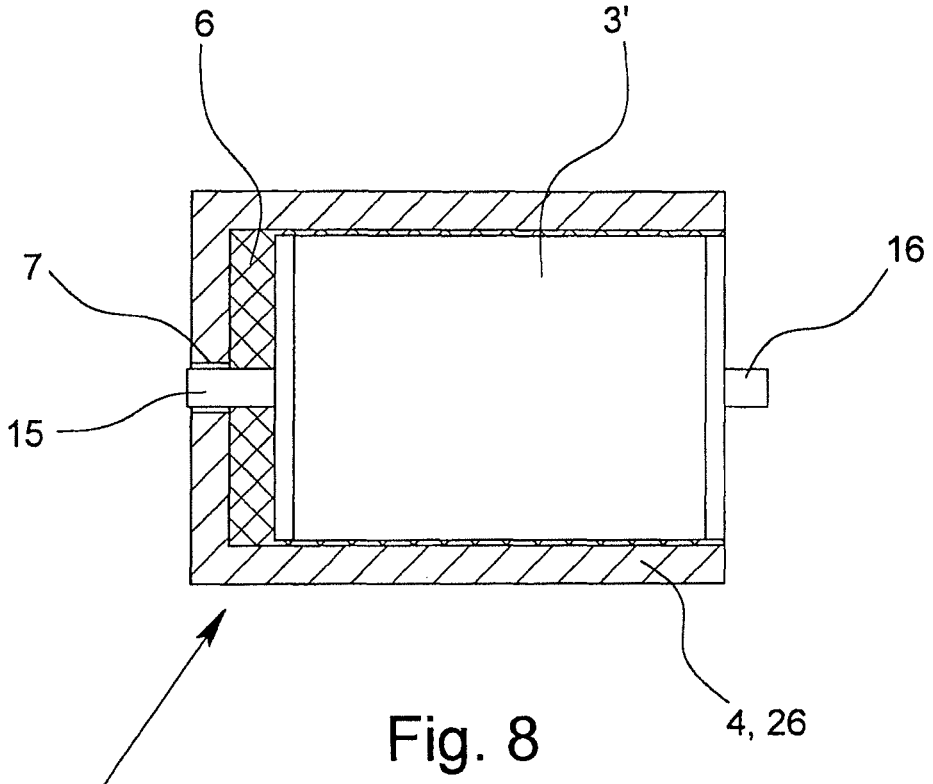
FIG. 8 shows the overvoltage protection element according to FIG. 7, in a plan view.
Figure 9:
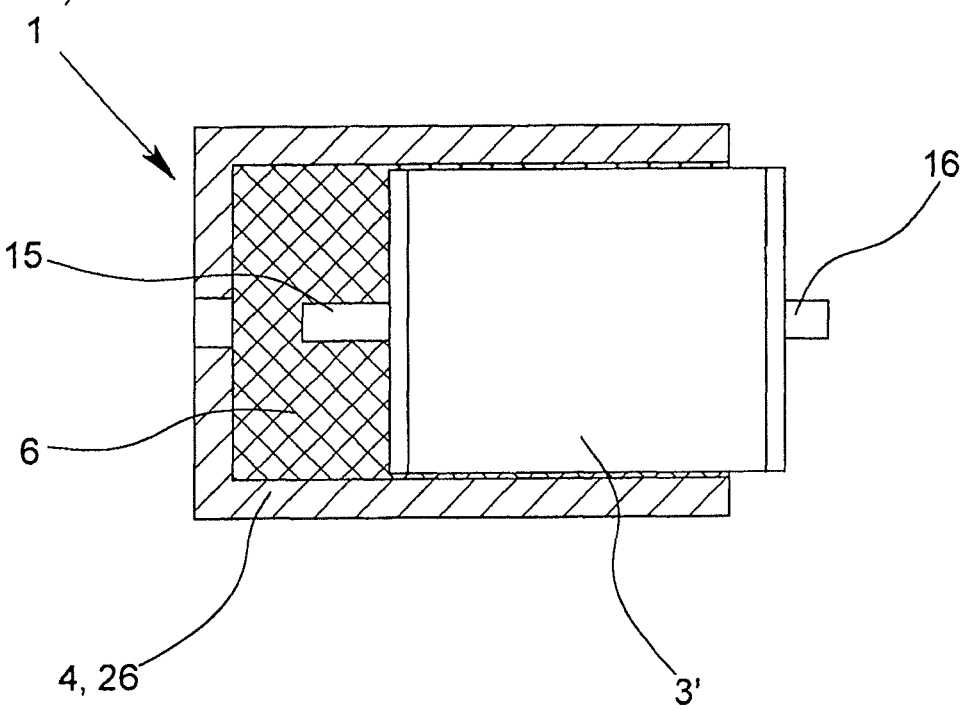
FIG. 9 shows the overvoltage protection element according to FIG. 8, with a disconnected surge arrester, in a plan view.

While in the exemplary embodiment according to FIGS. 4 to 6 the holding elements 26, 27 are made in such a way and the thermally expandable material 6 is located between the holding elements 26, 27 such that in thermal overloading of the surge arrester 3', it is forced upward by the expanding material 6, the surge arrester 3' in the exemplary embodiment according to FIGS. 7 to 9 is forced away horizontally to the side by the expanding material 6.

Fundamentally, an arc can occur in the opening of an electrical contact via which a current is flowing; in an overvoltage protection element 1, this can lead to an impermissible current flowing via the arc even in the actually disconnected state of the overvoltage limiting component. This arc, in the exemplary embodiment of the overvoltage protection element 1 which is shown in FIG. 2, is prevented by the expanding thermally expandable material 6 penetrating into the intermediate space which is forming between the terminal lugs 11, 12 and the receptacles 13, 14 in the thermal overloading of the varistor 3. Possible arcs are extinguished by the foaming around the terminal lugs 11, 12. This applies accordingly also to the left terminal post 15 of the surge arrester 3', which post is shown in FIG. 9.

In order to further extinguish an arc which arises when the electrical connection between the terminal lugs 11, 12 and the receptacles 13, 14 is broken, in the situation of the overvoltage protection element 1 shown in FIG. 3, the two connection elements 4, 5 are surrounded by a plastic part 29 which evolves gas when an arc is present. When an arc is present, a blowing on the arc is produced by the dissociation of the plastic parts 29, and as a result of which the arc is extinguished.

Figure 10:
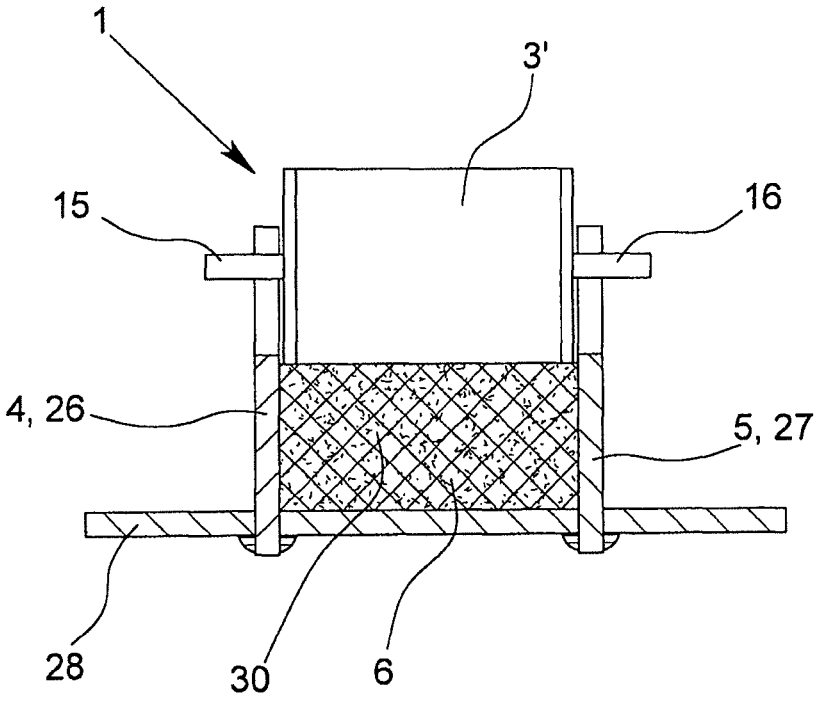
FIGS. 10-12 show three versions of the overvoltage protection element according to FIG. 6, with a disconnected surge arrester.
Figure 11:
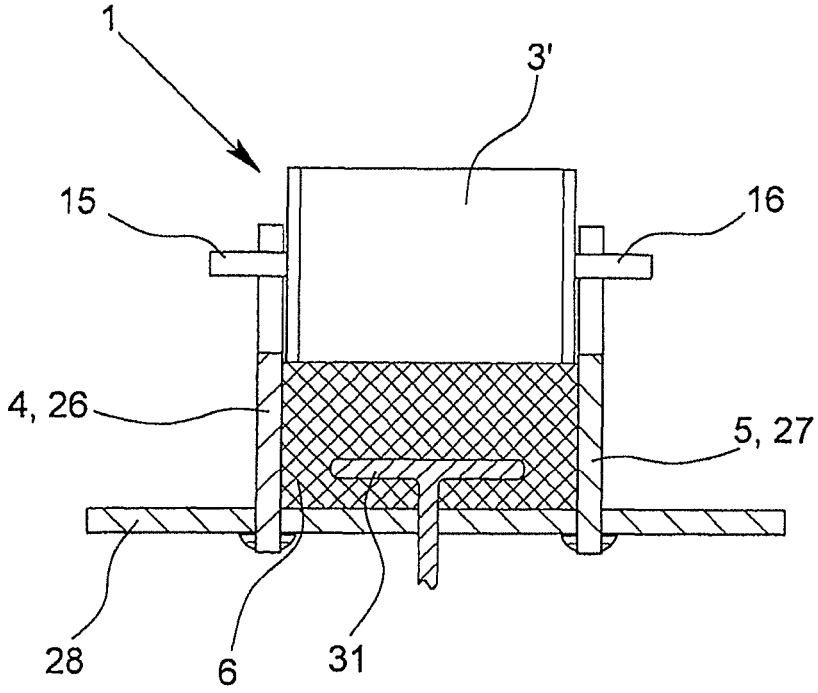
Figure 12:
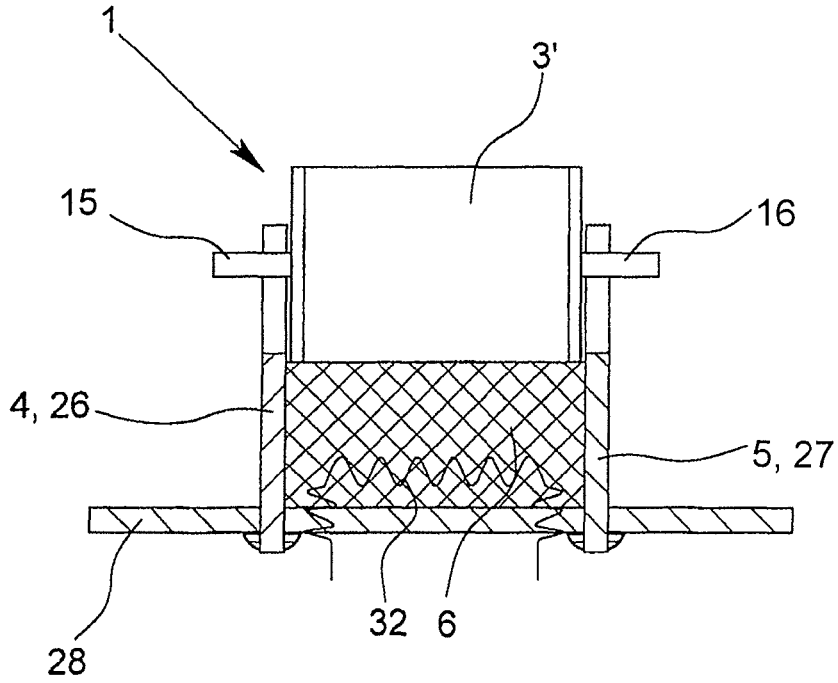

FIGS. 10-12 show three different versions of an overvoltage protection element 1 which differ from one another and from the version according to FIG. 6 only by the execution of the thermally expandable material 6.

In the exemplary embodiment according to FIG. 10, there are conductive particles 30 in the thermally expandable material 6. The conductive particles 30 can be, for example, graphite powder or copper powder. By adding the conductive particles 30, an inherent conductivity of the material 6 is achieved so that, when a voltage is present, a current flows through the thermally expandable material 6 by which the material 6 is heated throughout its volume. When the material 6 reaches its activation temperature, the volume increases; this also leads to the number of conductive components per unit of volume being reduced so that, with the increase in the volume, the conductivity of the material 6 is reduced, preferably to such an extent that current no longer flows through the material 6 at a maximum increase of the volume.

In the exemplary embodiments according to FIGS. 11 & 12, a heat pipe 31 or a resistance wire 32 is embedded in the thermally expandable material 6, as a result of which additional heating of the material 6 occurs when a current is flowing through the heat pipe 31 and the resistance wire 32. The connections of the heat pipe 31 and of the resistance wire 32 can be either routed out separately as shown in FIGS. 11 & 12 or can be connected to the connection elements 4, 5. In the latter case, the current via the surge arrester 3' can also be used for additional heating of the thermally expandable material 6 by the heat pipe 31 and the resistance wire 32.

It is apparent that the above described versions or configurations of the thermally expandable material 6 can be used not only in an overvoltage protection element 1 with a gas-filled surge arrester 3' according to FIG. 6, but also for an overvoltage protection element 1 with a varistor 3 according to FIG. 1.

What is claimed is:

1. An overvoltage protection element, comprising:

a housing, at least one overvoltage limiting component located in the housing, two connection elements for electrical connection of the overvoltage protection element to a current or signal path to be protected, each of the connection elements being in electrical contact with a pole of the respective overvoltage limiting component in a normal state of the overvoltage protection element, and a thermally expandable material within the housing, wherein the thermally expandable material is expandable in response to thermal overloading of the overvoltage limiting component, expansion of the thermally expandable material moving the at least one overvoltage limiting component so as to break said electrical contact between at least one pole of the overvoltage limiting component and the respective connection element, wherein the housing comprises an outer housing and an inner housing, the inner housing being open on one side and being located in the outer housing, wherein the connection elements are fixedly connected to the outer housing, wherein the overvoltage limiting component is located within the inner housing, wherein the inner housing surrounds the thermally expandable material in the normal state of the overvoltage protection element, and wherein the inner housing moves relative to the outer housing when the thermally expandable material expands as a result of heating of the overvoltage limiting component.

2. The overvoltage protection element as claimed in claim 1, wherein the at least one overvoltage limiting component is a varistor or a gas-filled surge arrester.

3. The overvoltage protection element as claimed in claim 1, wherein said electrical contact comprises a solder connection, the solder connection breaking when the temperature of the overvoltage limiting component exceeds a predetermined boundary temperature.

4. The overvoltage protection element as claimed in claim 1, wherein said electrical contact comprises a plug connection which separates upon expansion of the thermally expandable material.

5. The overvoltage protection element as claimed claim 1, wherein the poles of the overvoltage limiting component are each electrically connected conductively to a respective terminal lug or post.

6. The overvoltage protection element as claimed in claim 1, wherein the overvoltage limiting component is connected to the inner housing via a holding element, ends of the holding element being attached to an inner wall of the inner housing.

7. The overvoltage protection element as claimed in claim 1, wherein the inner housing has a first position completely within the outer housing in the normal state of the overvoltage protection element, and the inner housing being moved to a second position due to expansion of the thermally expandable material upon thermal overloading of the overvoltage protection element, the inner housing projecting out of the outer housing in said second position.

8. The overvoltage protection element as claimed claim 1, wherein each of the poles of the overvoltage limiting component are electrically connected to a respective terminal lug, wherein a sealing film is provided on the open side of the inner housing, and wherein, in the normal state of the overvoltage protection element, each terminal lug extends through the sealing film so as to be in electrical contact with the connection element.

9. The overvoltage protection element as claimed in claim 8, wherein said electrical contact comprises a plug connection that is separates upon expansion of the thermally expandable material, wherein a holding element is located under the overvoltage limiting component, wherein an opening is formed in the holding element through which can escape pressure which forms when the overvoltage limiting component is destroyed as a result of an extreme overload, so that the position of the inner housing with the overvoltage limiting component is caused to change relative to the outer housing so that the poles of the overvoltage limiting component are no longer in electrically conductive contact with the connection elements.

10. The overvoltage protection element as claimed in claim 9, wherein at least one opening is formed in the outer housing through which the pressure can escape when the inner housing is in the second position.

11. The overvoltage protection element as claimed claim 1, wherein the thermally expandable material is able to penetrate into an intermediate space between at least one pole or a terminal lug of the overvoltage limiting component and at least one connection element upon thermal overloading of the overvoltage limiting component so that an arc, which forms when the electrical contact between at least one pole and at least one connection element is broken, is suppressed or extinguished by the thermally expandable material.

12. The overvoltage protection element as claimed claim 1, wherein there is at least one plastic part which evolves gas when heated in the region of the connection elements.

13. The overvoltage protection element as claimed claim 1, wherein the thermally expandable material has an activation temperature of above 80° C.

14. The overvoltage protection element as claimed claim 13, wherein the activation temperature is between 120° C. and 150° C.

15. The overvoltage protection element as claimed claim 1, wherein the thermally expandable material is able to increase in volume by at least 200%.

16. The overvoltage protection element as claimed claim 1, wherein the thermally expandable material comprises a carrier agent with a low Shore hardness, and a propellant.

17. The overvoltage protection element as claimed claim 1, wherein the carrier agent comprises a thermoplastic polymer or an elastomer.

18. The overvoltage protection element as claimed in claim 16, wherein the propellant is a physically acting propellant.

19. The overvoltage protection element as claimed claim 1, further comprising a supplemental heating means for actively heating the thermally expandable material to support expansion thereof.

20. The overvoltage protection element as claimed claim 1, wherein the thermally expandable material is an intumescent material.

* * * * *